US006792668B2

(12) United States Patent
Herold et al.

(10) Patent No.: US 6,792,668 B2
(45) Date of Patent: Sep. 21, 2004

(54) METHOD FOR PRODUCING AN ELECTROMAGNETIC ACTUATOR

(75) Inventors: Sonja Herold, Althuette (DE); Thomas Stolk, Kirchheim (DE); Alexander Von Gaisberg, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/344,504

(22) PCT Filed: Oct. 2, 2001

(86) PCT No.: PCT/EP01/11374

§ 371 (c)(1),
(2), (4) Date: Feb. 10, 2003

(87) PCT Pub. No.: WO02/33228

PCT Pub. Date: Apr. 25, 2002

(65) Prior Publication Data

US 2003/0177630 A1 Sep. 25, 2003

(30) Foreign Application Priority Data

Oct. 14, 2000 (DE) ..... 100 51 076

(51) Int. Cl.[7] ..... H01F 7/06

(52) U.S. Cl. ..... 29/602.1; 29/592.1; 29/596; 29/598; 123/90.11; 251/129.1

(58) Field of Search ..... 29/592.1, 596, 29/598, 602.1; 123/90.11; 251/129.1

(56) References Cited

U.S. PATENT DOCUMENTS

| | | | | |
|---|---|---|---|---|
| 3,882,833 A | 5/1975 | Longstaff et al. | ..... | 123/90.11 |
| 4,809,742 A | 3/1989 | Grau | ..... | 137/554 |
| 5,117,213 A | 5/1992 | Kreuter et al. | ..... | 335/219 |

(List continued on next page.)

FOREIGN PATENT DOCUMENTS

| | | | | |
|---|---|---|---|---|
| DE | 19529152 | | 2/1997 | |
| DE | 19631909 | | 2/1997 | |
| DE | 19725010 | | 10/1998 | |
| DE | 19733142 | | 2/1999 | |
| DE | 19849036 | | 5/2000 | |
| DE | 19927823 | | 1/2001 | |
| GB | 0328192 | | 8/1989 | |
| JP | 02081940 A | * | 3/1990 | ..... F02D/41/16 |
| WO | WO97/17561 | | 5/1997 | |

OTHER PUBLICATIONS

"The adaptive fuzzy control of electromagnetic actuator in diesel fuel injection system"; Yuanchun Li; Wei Gao; Xiao Zhou; Vehicle Electronics Conference, 1999, Sept. 6–9, 1999; pp.: 149–152 vol. 1.*

*Primary Examiner*—A. Dexter Tugbang
*Assistant Examiner*—Paul Kim
(74) *Attorney, Agent, or Firm*—W. F. Fasse; W. G. Fasse

(57) ABSTRACT

An electromagnetic actuator includes two electromagnets arranged opposite one another, an armature movable back and forth between the electromagnets against the force of two mutually counteracting springs, and an adjusting device for adjusting the armature rest position. After several hours of operation, due to settling of components, the pre-tension of the springs changes. To counteract that and achieve a durable adjustment of the pre-tension, the actuator is pre-settled before being placed in service. In this regard, the springs are compressed in repeating compression cycles so often until the energy respectively stored therein due to their compression no longer or only insignificantly differs from the energy stored in the respective spring in a preceding compression cycle, and thereafter the pre-tension of the springs is adjusted. The electromagnetic actuator is useful for controlling the gas exchange in an internal combustion engine.

7 Claims, 2 Drawing Sheets

U.S. PATENT DOCUMENTS 5,119,392 A * 6/1992 Childs ..... 372/38.08
5,199,392 A * 4/1993 Kreuter et al. ..... 123/90.11
5,548,263 A * 8/1996 Bulgatz et al. ..... 335/274
5,636,601 A * 6/1997 Moriya et al. ..... 123/90.11
5,804,962 A 9/1998 Kather et al. ..... 324/207.16
5,822,167 A 10/1998 Schmitz ..... 361/143
5,934,231 A 8/1999 Schmitz et al. ..... 123/90.11
6,021,749 A 2/2000 Gaisberg ..... 123/90.11
6,176,208 B1 1/2001 Tsuzuki et al. ..... 123/90.11
6,230,673 B1 * 5/2001 Sugimoto et al. ..... 123/90.11
6,481,395 B2 11/2002 Kreitmann et al. ..... 123/90.11

* cited by examiner

METHOD FOR PRODUCING AN ELECTROMAGNETIC ACTUATOR

FIELD OF THE INVENTION

The invention relates to a method for producing an electromagnetic actuator including an armature driven by two electromagnets against two oppositely acting springs.

BACKGROUND INFORMATION

An electromagnetic actuator for operating a gas exchange valve in an internal combustion engine is known from the DE 196 31 909 A1. The previously known actuator comprises two electromagnets arranged at a spacing distance relative to each other, and an armature that is operatively connected with the gas exchange valve, and that is movable back and forth between the electromagnets due to magnetic force, against the force of a spring arrangement of two mutually counteracting springs. The actuator further comprises adjusting means, with which the idle or resting position of the armature, that is to say the position of the armature with unenergized current-less electromagnets, is adjusted to the geometric center between the two end positions of the armature. In this context it is found to be disadvantageous, that the resting position can become shifted during the operation, so that after several hours of operation, a readjustment of the resting position is necessary.

From the DE 199 27 823, which is not previously published, an electromagnetic actuator of the initially mentioned type is known, in which the pre-tensioning of the springs is adjusted in such a manner, so that the same energy is stored in the springs due to the compression of the springs resulting from the armature motion.

SUMMARY OF THE INVENTION

It is the object underlying the invention to specify a method producing an electromagnetic actuator, which enables an adjustment of the pre-tension of the springs that is durable and optimal for the operation of the actuator.

The above objects have been achieved according to the invention in a method of producing an electromagnetic actuator with the following special features.

According to the invention, an electromagnetic actuator, which comprises two electromagnets arranged at a spacing distance relative to one another, and an armature that is movable back and forth between the electromagnets against the force of two oppositely acting springs, is placed into operation in two successive method steps. In the first method step, the springs are respectively compressed by a certain compression value in repeating compression cycles, so often until the energy, which is stored therein due to their compression, no longer or only insignificantly differs from the energy stored in the respective spring in a preceding compression cycle. Then, in a subsequent method step, an adjustment of the pre-tension of the one spring or of both springs is carried out.

Preferably, the compression value is selected to be equal to the value by which the springs are compressed during the specified operation of the actuator.

The goal of the first method step is to achieve and recognize, as much as possible, a complete setting or settling of the springs and parts of the actuator that move together with the armature. In this context, by the term setting or settling of the springs and of the moved parts of the actuator, one understands a change of the pre-tension of the springs or of the dimensions of the moved parts of the actuator, which results from the operationally caused relaxation phenomena or manifestations in the material structure or grain of the springs and the utilized components. The first method step thus leads to a stationary operating condition, in which the spring characteristics no longer change or only insignificantly change with an increasing number of compression cycles, that is to say with an increasing number of operating hours. Due to the adjustment of the pre-tension of one of the two springs or of both springs, which is carried out only in the subsequent method step, one achieves that setting or settling effects no longer play any role in the following operation and thus also do not make a readjustment of the pre-tension of the one spring or of both springs necessary.

Preferably, the energy stored in the respective spring is determined in that the course of the spring force of the spring that results during the compression of this spring is detected and integrated over the path length or distance corresponding to the compression.

In an advantageous embodiment of the method, the pre-tension of the one spring or of both springs is adjusted in such a manner so that the same energy is stored in both springs due to their compression resulting from the armature motion.

Hereby one achieves that the armature, if it is released from its two end positions and oscillates freely, approaches equally close to the respective oppositely located end positions. As a result of this, the influence of production-caused tolerances of the components, especially of the springs, on the oscillating behavior of the armature is reduced. Additionally, the total energy requirement of the actuator is optimized, because both electromagnets comprise the same current requirement due to the armature approaching equally close thereto. Namely, if the armature, during free oscillation, would approach closer to the one electromagnet than the other, then the current requirement of the one electromagnet would be reduced by a certain amount, whereas, however, the current requirement of the other electromagnet would increase by a multiple of this amount, so that also the total energy requirement of the actuator would increase relative to the optimal value.

BRIEF DESCRIPTION OF THE DRAWINGS

A preferred example embodiment of the invention is described in greater detail in the following, in connection with the drawings, wherein.

DETAILED DESCRIPTION OF A PREFERRED EXAMPLE EMBODIMENT OF THE INVENTION

Figure 1:
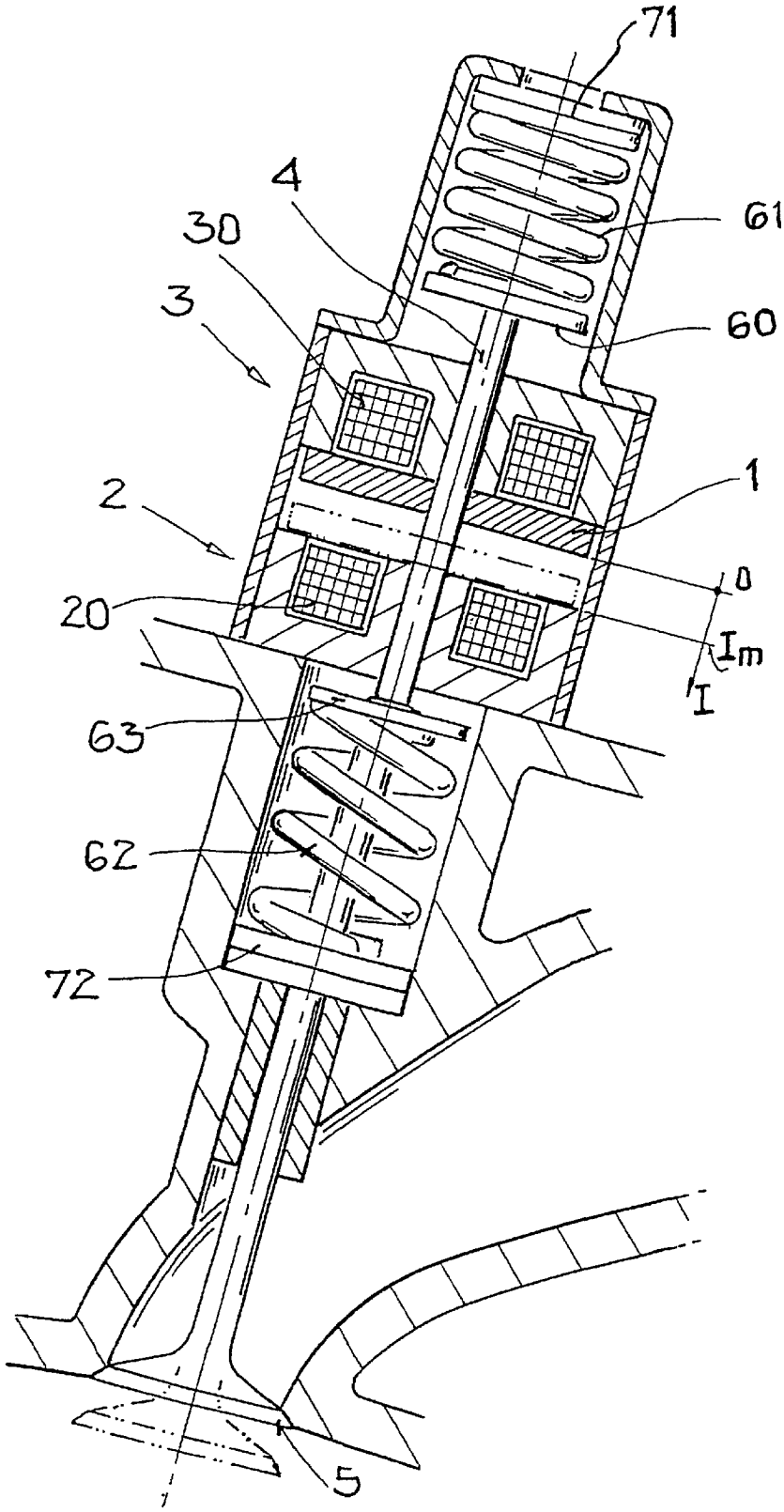
FIG. 1 shows a general principle illustration of an electromagnetic actuator for operating a gas exchange valve in an internal combustion engine.

According to the FIG. 1, the actuator comprises a pushrod 4 operatively connected with a gas exchange valve 5, an armature 1 secured with the pushrod 4 perpendicularly to the pushrod longitudinal axis, an electromagnet 3 acting as a closing magnet, as well as a further electromagnet 2 acting as an opening magnet, which is arranged spaced apart from the closing magnet 3 in the direction of the pushrod longitudinal axis. The electromagnets 2, 3 respectively comprise an exciting or energizing coil 20 or 30 and mutually oppositely located pole surfaces. By alternately supplying current to the two electromagnets 2, 3, that is to say the energizing coils 20 or 30, the armature 1 is moved back and forth between the electromagnets 2, 3 along a stroke path limited by the electromagnets 2, 3. A spring arrangement with a first spring 61 that acts via a first spring retaining disk 60 on the armature 1 in the opening direction and a second spring 62 that acts via a second spring retaining disk 63 on the armature 1 in the closing direction achieve that the armature 1 is held in a balanced or equilibrium position between the electromagnets 2, 3 in the unenergized current-less condition of the energizing coils 20, 30. Furthermore, adjusting means 71, 72 for adjusting the pre-tension of the springs 61, 62 are provided. The adjusting means 71, 72 may, for example, be embodied as disks that effectuate a compression of the springs 61, 62 and thus prescribe the pre-tension of the respective springs 61, 62. They can, however, also be embodied controllably and enable a continuous or stepless variation of the pre-tension.

For starting the actuator, one of the electromagnets 2, 3 is energized with a current, that is to say switched on, by applying an exciting or energizing voltage to the corresponding energizing coil 20 or 30, or a start-up transient oscillation routine is initiated, through which the armature 1 is first set into oscillation by alternating application of current to the electromagnets 2, 3 in order to strike against the pole surface of the closing magnet 2 or the pole surface of the opening magnet 3 after a start-up transient time.

With a closed gas exchange valve 5, the armature 1 lies against the pole surface of the closing magnet 3 as shown in FIG. 1, and it is held in this position—the upper end position or closing position—as long as the closing magnet 3 is supplied with current. In order to open the gas exchange valve 5, the closing magnet 3 is switched off and then the opening magnet 2 is supplied with current. The first spring 61 which acts in the opening direction accelerates the armature 1 through and past the resting position. By means of the opening magnet 2, which is now supplied with current, additional kinetic energy is supplied to the armature 1, so that it reaches the pole surface of the opening magnet 2 despite possible frictional losses, and there the armature 1 is held at the lower end position or open position as shown with dashed lines in FIG. 1 until the opening magnet 2 is switched off. For once again closing the gas exchange valve 5, the opening magnet 2 is switched off and the closing magnet 3 is then once again switched on. Thereby, the armature 1 is moved by the second spring 62 to the closing magnet 3, and there is held on its pole surface in the closing position.

Figure 2:
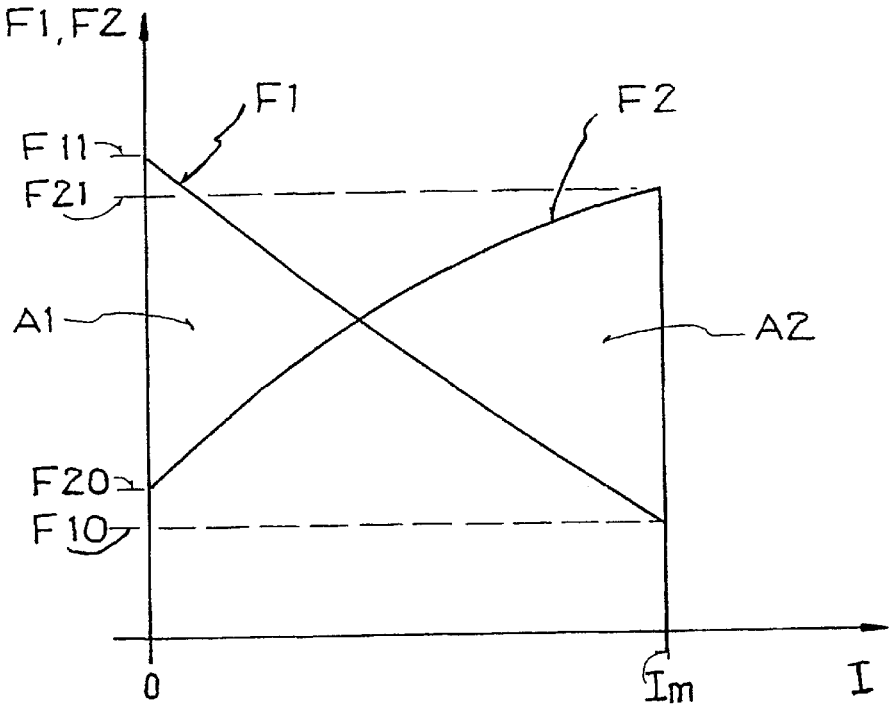
FIG. 2 shows a force-displacement diagram for the spring forces of two springs of the actuator of FIG. 1.

The stroke path distance or displacement Im of the armature 1, that is to say the path distance that the armature 1 traverses during its motion—the motion of the armature 1 will be designated in the following as the flight—, is limited due to the prescribed spacing distance between the electromagnets 2, 3. The courses or progressions of the spring forces of the two springs 61, 62, that is to say the forces with which the springs 61, 62 act on the armature 1, are dependent on the armature position I and can be described in connection with spring characteristic curves or functions. In the force-displacement diagram in FIG. 2, the spring characteristic curve or function of the first spring 61 is referenced with F1, and the spring characteristic curve or function of the second spring 62 is referenced with F2. In the present example embodiment, different springs are used; their spring characteristic curves or functions thus differ from one another. However, it is also conceivable to use equivalent springs.

During the flight of the armature 1 from the upper end position to the lower end position, that is to say from the armature position 0 to the armature position Im, the force of the first spring 61 diminishes or falls off from a holding value F11 to an end value F10, which is reached at the armature position Im, that is to say with the armature 1 lying against the opening magnet 2. The spring force of the second spring 62, in comparison, rises or increases from an end value F20 effective in the upper end position of the armature 1 to a holding value F21 which is reached in the lower end position of the armature 1. The end values F10, F20 specify the pre-tension of the respective springs 61 or 62, and the surface areas A1 and A2 below the spring characteristic curves or functions F1 or F2 correspond to the energy that is stored in the respective spring 61 or 62, when these are compressed due to the armature motion by the amount I=Im.

Due to the setting or settling of the springs 61, 62 and of the moved parts of the actuator, especially due to the setting or settling of wedges, by means of which the second spring retaining disk 63 is connected with the gas exchange valve 5, which setting or settling arises during the operation, the pre-tension of the springs diminishes or falls off, which leads to a shifting of the spring characteristic curves or functions F1, F2 and therewith to a reduction of the surface areas A1, A2 under the spring characteristic curves or functions F1, F2. That also means, however, that the energy that is respectively stored in the springs 61, 62 by means of the compression thereof resulting from the armature motion, is reduced with the increasing number of the compression cycles.

Figure 3:
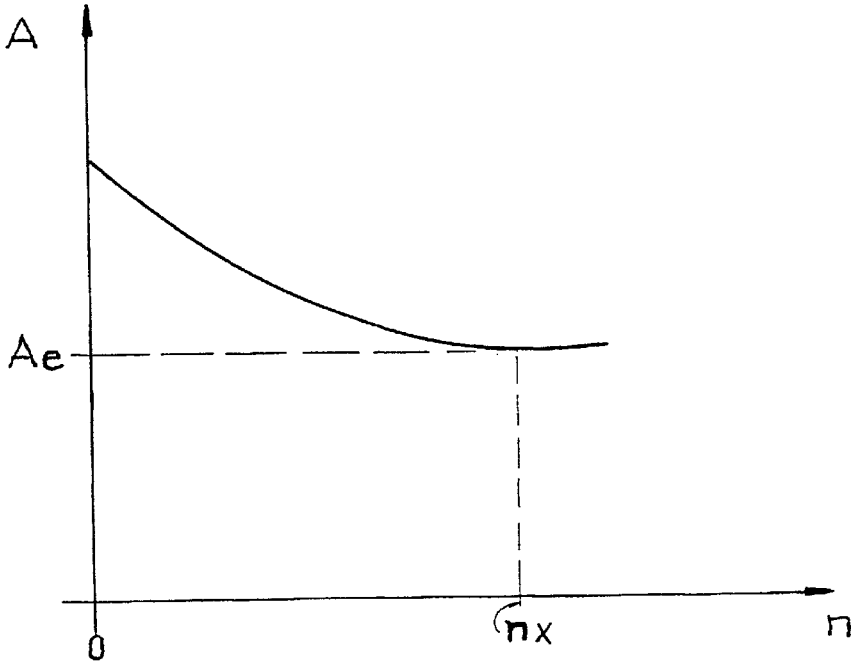
FIG. 3 shows the energy stored in a spring dependent on the number of compression cycles.

FIG. 3 shows the connection or relation between the energy A stored in a spring and the number n of compression cycles in which the spring is respectively compressed by the same value. It is apparent that the energy A diminishes with increasing number n of the compression cycles and thereby asymptotically approaches an end value Ae. After a certain number nx of compression cycles, the energy A is nearly equal to the end value Ae and the setting process can be regarded as completed.

In order to enable an adjustment of the pre-tension of the two springs 61, 62 that is optimal for the operation of the actuator according to the specified conditions, it is necessary to ensure that the spring characteristic curves or functions F1, F2 do not shift during the operation. One achieves this in that during the production of the actuator, first a partial assembly is carried out, in which the first spring 61 is installed into the part enclosing the electromagnets 2, 3 and the armature 1 and the second spring 62 is installed with the gas exchange valve 5 and the second spring retaining disk 63 in the cylinder head of the internal combustion engine, and in that the springs in these partial assemblies are compressed independently from one another in repeating compression cycles respectively by a certain compression value, whereby the compression cycles are repeated so often until the setting process is completed. The compression value in this context is selected to be equal to that value by which the springs 61, 62 are compressed during the operation of the actuator according to the prescribed conditions.

As an alternative thereto, the armature 1 can also be moved back and forth in repeating motion cycles, which correspond to the compression cycles of the springs 61, 62, between its end positions 0, Im prescribed by the electromagnets 2, 3, so often until the setting process is completed, with a completely assembled and thus ready-for-operation actuator when placing the actuator into operation, that is to say before the operation according to the prescribed conditions. In that regard, the armature 1 can be set into motion by the magnetic force of the electromagnets 2, 3 or by external force influence.

The energy A1, A2 that is stored in the respective spring 61 or 62 due to its compression is determined in the successive compression cycles. In this context, the determination of the energy A1 or A2 is achieved in that the spring force F1 or F2 arising during the motion of the armature is measured section-wise and integrated section-wise over the spring displacement path or travel distance. The measurement of the spring force F1 or F2 can be carried out by means of a load cell or a dial gage, but also with other pressure sensors, especially with piezoelectric crystals. If the difference between the energy A1 or A2 determined in the present compression cycle and the energy determined in a preceding compression cycle for the same spring 61 or 62 is smaller than a prescribed value, then this is an indication that the setting process is completed. Thus, the compression cycles are repeated so often until the energy A1 or A2 that is stored in the respective spring 61 or 62 due to the spring compression resulting from the armature motion no longer differs or only insignificantly differs, that is to say by a value that is negligible in the scope of the measuring accuracy, from the energy that is stored in the respective spring 61 or 62 in a preceding compression cycle.

Through the comparison of the energies A1 or A2 stored in the respective springs 61 or 62 in successive compression cycles it is possible to determine the time point at which the setting process is completed or ended, in order to then next carry out the adjustment of the pre-tension of the first and/or second spring 61 or 62 that is optimal for the operation according to the prescribed conditions. With respect to the energy requirement, an adjustment has been shown to be optimal, which leads to the result that the same energy A1, A2 is stored in the two springs 61, 62, if the springs 61, 62 are respectively compressed by the travel distance or displacement corresponding to the stroke path distance Im.

What is claimed is:

1. A method for producing an electromagnetic actuator that includes two electromagnets (2, 3) arranged at a spacing distance relative to one another, and an armature (1) that is movable back and forth between the electromagnets (2, 3) against the force of two oppositely acting springs (61, 62), said method comprising steps of compressing the springs (61, 62) by a certain compression value in repeating compression cycles so often until a present cycle energy (A1, A2) scored in each said springs (61, 62) due to a compression in a present cycle of said compression cycles no longer or only insignificantly differs from a prior cycle energy stored in the respective said spring (61, 62) in a prior cycle of said compression cycles, and following thereafter, adjusting a pre-tension (F10, F20) of one of the said springs (61, 62) or of both of said springs (61, 62).

2. The method according to claim 1, wherein said certain compression value is selected equal to a value by which said springs (61, 62) are compressed during a subsequent operation of the actuator.

3. The method according to claim 1, further comprising determining said present cycle energy and said prior cycle energy respectively stored in the said springs (61, 62) by detecting a course of a spring force (F1, F2) of said springs respectively arising through the compression of the respective one of said springs (61, 62) and integrating said spring force over a travel displacement corresponding to the compression of the respective one of said springs.

4. The method according to claim 1, wherein said pre-tension (F10, F20) of one or of both of said springs (61, 62) is adjusted so that a first energy stored in a first one of said springs due to the compression thereof is equal to a second energy stored in a second one of said springs (61, 62) due to the compression thereof when said pre-tension has been adjusted.

5. A method of preparing a newly assembled electromagnetic actuator arrangement for operation prior to being placed in service, wherein the arrangement includes an armature that is movable between two electromagnets and biased by opposed first and second springs, and wherein the method comprises the steps:

a) settling said newly assembled electromagnetic actuator arrangement by cyclically compressing and decompressing said first spring in repeating first compression cycles and cyclically compressing and decompressing said second spring in repeating second compression cycles;

b) determining a first spring energy stored in said first spring due to said compressing thereof in said first compression cycles, an determining a second spring energy stored in said second spring due to said compression thereof in said second compression cycles;

c) continuing said steps a) and b) until said first spring energy change no more that insignificantly over successive compression cycle of said first compression cycles and said second spring energy changes no more an insignificantly over successive compressor cycle of said second compression cycles, and then discontinuing said step a);

d) after said step c), adjusting at least a first pre-tension of said first spring to an operational pre-tens ion setting; and e) after said step d), placing said electromagnetic actuator arrangement into service.

6. The method according to claim 5, wherein said determining of said first spring energy comprises measuring and integrating a first spring force exerted by said first spring over a compression distance of said compression thereof in said first compression cycles, and said determining of said second spring energy comprises measuring and integrating a second spring force exerted by said second spring over a compression distance of said compression thereof in said second compression cycles.

7. The method according to claim 5, wherein said adjusting in said step d) is carried out such that said first spring energy is equal to said second spring energy after carrying out said adjusting.

* * * * *

UNITED STATES PATENT AND TRADEMARK OFFICE

CERTIFICATE OF CORRECTION

PATENT NO. : 6,792,668 B2
DATED : September 21, 2004
INVENTOR(S) : Herold et al.

It is certified that error appears in the above-identified patent and that said Letters Patent is hereby corrected as shown below:

Title page,
Item [56], References Cited, U.S. PATENT DOCUMENTS, please delete "5,119,392 A * 6/1992 Childs".

Column 5,
Lines 46-52, replace these lines to read:
-- A2) stored in each said spring (61, 62) due to a compression of each said spring in a present cycle of said compression cycles no longer or only insignificantly differs from a prior cycle energy stored in the respective said spring (61, 62) in a prior cycle of said compression cycles, and following thereafter, adjusting a pre-tension (F10, F20) of one of said springs (61, 62) or of both of said springs (61, 62). --.

Column 6,
Lines 27-41, replace these lines to read:
-- b) determining a first spring energy stored in said first spring due to said compressing thereof in said first compression cycles, and determining a second spring energy stored in said second spring due to said compression thereof in said second compression cycles;
c) continuing said steps a) and b) until said first spring energy changes no more than insignificatly over successive compression cycles of said first compression cycles and said second spring energy changes no more then insignificantly over successive compression cycles of said second compression cycles, and then discontinuing said step a);
d) after said step c) adjusting at least a first pre-tension of said first spring to an operational pre-tension setting; and --.

Signed and Sealed this

Fifteenth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,792,668 B2
DATED : September 21, 2004
INVENTOR(S) : Herold et al.

It is certified that error appears in the above-identified patent and that said Letters Patent is hereby corrected as shown below:

Title page,
Item [56], References Cited, U.S. PATENT DOCUMENTS, please delete "5,119,392 A * 6/1992 Childs".

Column 5,
Lines 46-52, replace these lines to read:
-- A2) stored in each said spring (61, 62) due to a compression of each said spring in a present cycle of said compression cycles no longer or only insignificantly differs from a prior cycle energy stored in the respective said spring (61, 62) in a prior cycle of said compression cycles, and following thereafter, adjusting a pre-tension (F10, F20) of one of said springs (61, 62) or of both of said springs (61, 62). --.

Column 6,
Lines 27-41, replace these lines to read:
-- b) determining a first spring energy stored in said first spring due to said compressing thereof in said first compression cycles, and determining a second spring energy stored in said second spring due to said compression thereof in said second compression cycles;
c) continuing said steps a) and b) until said first spring energy changes no more than insignificantly over successive compression cycles of said first compression cycles and said second spring energy changes no more than insignificantly over successive compression cycles of said second compression cycles, and then discontinuing said step a);

UNITED STATES PATENT AND TRADEMARK OFFICE

CERTIFICATE OF CORRECTION

PATENT NO. : 6,792,668 B2
DATED : September 21, 2004
INVENTOR(S) : Herold et al.

It is certified that error appears in the above-identified patent and that said Letters Patent is hereby corrected as shown below:

Column 6, (cont)

d) after said step c) adjusting at least a first pre-tension of said first spring to an operational pre-tension setting; and --.

This certificate super supersedes Certificiate of Correction issued February 15, 2005.

Signed and Sealed this

Third Day of May, 2005

JON W. DUDAS
*Director of the United States Patent and Trademark Office*